United States Patent [19]

Seeman

[11] 4,312,367

[45] Jan. 26, 1982

[54] SMOKING COMPOSITIONS

[75] Inventor: Jeffrey I. Seeman, Richmond, Va.

[73] Assignee: Philip Morris Incorporated, New York, N.Y.

[21] Appl. No.: 147,895

[22] Filed: May 8, 1980

[51] Int. Cl.[3] ..... A24B 3/12

[52] U.S. Cl. ..... 131/276; 131/278

[58] Field of Search ..... 131/17 R, 14, 278, 275, 131/276

[56] References Cited

U.S. PATENT DOCUMENTS

| | | | |
|---|---|---|---|
| 1,407,274 | 2/1922 | Hibbert et al. | 131/17 R |
| 1,842,266 | 1/1932 | Hicks | 131/17 R |
| 1,941,416 | 12/1933 | Pettersson | 131/17 R |
| 1,954,109 | 4/1934 | Whitaker | 131/17 R |
| 1,961,866 | 6/1934 | Rocker | 131/17 R |
| 2,114,281 | 4/1938 | Allen | 131/17 R |
| 2,788,372 | 4/1957 | Arden | 131/17 R |
| 2,890,222 | 6/1959 | Omietanski | 131/278 |
| 2,985,549 | 5/1961 | Rosenthal | 131/17 R |
| 3,402,051 | 9/1968 | Roberts | 131/17 R |
| 3,684,809 | 8/1972 | Mookhersee et al. | 131/17 R |
| 3,705,158 | 12/1972 | Pittet et al. | 260/250 R |
| 3,754,934 | 8/1973 | Pittet et al. | 131/17 R |
| 3,764,349 | 10/1973 | Mookherjee et al. | 131/17 R |
| 3,767,426 | 10/1973 | Evers et al. | 131/17 R |
| 3,782,391 | 1/1974 | Means et al. | 131/17 R |
| 3,854,485 | 12/1974 | Mold et al. | 131/17 R |
| 3,881,025 | 4/1975 | Flament | 131/17 R |
| 3,914,227 | 10/1975 | Pittet et al. | 131/17 R |
| 4,036,237 | 7/1977 | Teug | 131/17 R |
| 4,166,869 | 9/1979 | Flament | 131/17 R |

FOREIGN PATENT DOCUMENTS

| | | | |
|---|---|---|---|
| 1244068 | 8/1971 | United Kingdom | 131/17 R |

OTHER PUBLICATIONS

I. Schmeltz and D. Hoffman, *Chem. Rev.*, 77, 295, (1977).

R. L. Stedman, *Chem. Rev.*, 68, 153, (1968).

G. B. Neurath, *Beitr. Tabakforsch*, 5, 115, (1969).

M. S. Bagget et al., *J. Chromatag.*, 97, 79, (1974).

*Primary Examiner*—V. Millin

*Attorney, Agent, or Firm*—Arthur I. Palmer, Jr.; George E. Inskeep

[57] ABSTRACT

This invention provides tobacco and non-tobacco smoking compositions which contain a quaternary ammonium compound as a flavorant additive.

In one of its embodiments this invention provides tobacco compositions which contain a quaternary ammonium flavorant additive such as

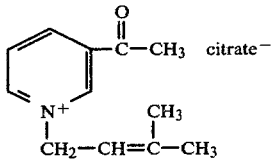

Under smoking conditions the above illustrated pyridinium additive and its pyrolysis products flavor the mainstream smoke.

30 Claims, No Drawings

SMOKING COMPOSITIONS

BACKGROUND OF THE INVENTION

There has been continuing interest in organic materials which can function as additives for modifying or improving the flavor and aroma and other properties of smoking compositions, e.g., additives such as flavorants and humectants.

Numerous nitrogen containing compounds have been isolated from tobacco and tobacco smoke [c.f. I. Schmeltz and D. Hoffmann, Chem. Rev., 77, 295 (1977); R. L. Stedman, Chem. Rev. 68, 153 (1968); G. B. Neurath, Beitr. Tabakforsch., 5, 115 (1969)] and many of these are known to be important to tobacco flavor. Of particular importance and significance are nitrogen heterocycles such as pyrazines and pyridines, their alkyl derivatives and their heteroatom derivatives.

Thus, it has been established that alkyl-pyrazines are natural components of tobacco smoke, and that they most probably are important contributors to tobacco smoke flavor [A. Baggett et al, *J. Chromatog,* 97 79 (1974)]. Further, it has been disclosed in the patent literature that addition of alkylpyrazines to tobacco results in an improvement in the flavor of smoking compositions as perceived by a test panel.

British Pat. No. 1,244,068 describes a method for influencing the smoke flavor of tobacco or a tobacco mixture which consists of treating the tobacco with a pyrazine derivative of the following chemical structure:

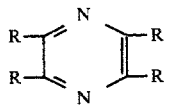

in which each R is independently a hydrogen atom, an aliphatic radical, an alicyclic radical or an aromatic hydrocarbon radical, such radicals having up to 9 carbon atoms, or R is a heterocyclic radical containing 4 to 9 carbon atoms.

U.S. Pat. No. 3,402,051 describes a process for imparting a popcorn-like flavor and aroma to tobacco and foodstuffs by the incorporation of a 2-acetylpyrazine derivative therein.

Other patents which disclose the addition of various pyrazine compounds to tobacco and foodstuffs as a means of providing flavor or flavor enhancement include U.S. Pat. Nos. 3,684,809; 3,705,158; 3,754,934; 3,764,349; 3,767,426; and 3,881,025.

U.S. Pat. No. 3,914,227 discloses pyridyl and pyrazyl ketones and their use in altering the organoleptic properties of tobacco and foodstuffs, and U.S. Pat. No. 4,166,869 discloses acylpyrimidines useful as flavorants for the same type of applications.

Alkylpyridines have also been found to be useful tobacco additives. As an example, U.S. Pat. No. 3,625,224 describes the use of methylpyridines, ethylpyridines and various dialkylpyridines as tobacco additives. U.S. Pat. No. 3,381,69 discloses 2-methyl-5-isopropylpyridine as a tobacco additive.

It is characteristic of pyridine, pyrazine, pyrimidine, and other heterocyclic derivatives employed as tobacco flavorants in the prior art, as illustrated by the above described technical literature, that the respective heterocyclic derivatives have the disadvantage of both high volatility and low odor threshold. Both of these properties significantly restrict the extent that these heterocyclic derivatives can be utilized as flavorants in tobacco compositions. A quantity of a pyrazine or pyridine derivative in a tobacco composition sufficient to have a noticeable effect in low delivery cigarettes causes a marked pack aroma.

When an aldehyde flavorant such as cinnamaldehyde is added to a smoking composition, the loss of the flavorant during the manufacturing process and during storage is high, due to the relatively high vapor pressure of the aldehydic compound.

Further, as described in U.S. Pat. No. 3,782,391 alkyl esters of beta-methyl valeric acid are known to impart a fruity, apple-like aroma and a nut-like flavor when incorporated in tobacco. However, as noted in U.S. Pat. No. 3,854,485, such flavorant compounds are relatively valuable substances with a low odor threshold, and they present an evaporation problem in prolonged storage of the flavored tobacco compositions. Other esters such as monoalkyl and dialkyl malonates are known to provide a tobacco smoke with a fermented apple-peel and walnut-like flavor and aroma, but such esters yield only a limited form of flavor enhancement in tobacco products.

U.S. Pat. No. 4,036,237 endeavors to overcome some of the disadvantages of the above-described flavorant technology. The said patent provides for the incorporation in smoking compositions of a flavorant compound which imparts cherry-like or fruity flavor to the smoke thereof, which flavorant compound is not lost during the manufacture and storage of the flavored smoking composition, and which is readily released when the smoking composition is burned. Illustrative of a U.S. Pat. No.4,036,237 flavorant compound is ethyl 2,2-dimethyl-3-hydroxy-3-phenylpropionate.

Other prior art is concerned with the incorporation into tobacco fillers of additives having humectant properties for the retention of moisture and the prevention of staleness in smoking compositions.

U.S. Pat. No. 1,407,274 proposes a method of improving the moisture-retaining properties of tobacco by incorporating a 1,2-glycol such as ethylene glycol into the tobacco matrix.

U.S. Pat. No. 1,954,109 discloses a method of preparing a smoking composition which consists of coating a tobacco filler with a water solution of a gelatinous material which tends to retain moisture in the tobacco.

U.S. Pat. No. 1,961,866 describes a method of controlling the moisture content of tobacco which involves incorporating pectin in the tobacco to function as a humectant.

U.S. Pat. No. 2,286,639 proposes the use of ammoniated aldose as an anti-staling agent in tobacco compositions. U.S. Pat. No. 2,114,281 describes the incorporation of a strongly absorbent material such as alumina hydrogel in tobacco. The absorbent retains water, and releases it under smoking conditions.

U.S. Pat. No. 2,788,372 describes the preparation of a sorbitol/1,2-alkylene oxide condensation product which is recommended as a humectant for stabilizing the moisture content of tobacco, cosmetics, paper products, and the like. U.S. Pat. No. 2,438,418 proposes the use of alpha-methylglycerine as a tobacco humectant which does not product toxic combustion products under smoking conditions.

Other prior art publications which provide background perspective for the present invention are those which relate to the presence of quaternary ammonium compounds as components of smoking tobacco compositions. In some cases the quaternary ammonium compound is formed in situ by treatment of the tobacco, and in other cases the quaternary ammonium compound is incorporated in the tobacco filler as an additive.

For example, U.S. Pat. No. 1,842,266 describes a method for alleviating the undesirable effects of tobacco by incorporating Vitamin B (thiamine hydrochloride) into the tobacco composition prior to smoking.

U.S. Pat. No. 1,941,416 discloses a method for neutralizing the properties of tobacco smoke which irritate the mucous membranes. The proposed method involves the incorporation of diamino-methylacridinium chloride in tobacco filler, which quaternary compound volatilizes under smoking conditions into mainstream smoke.

French Pat. No. 1,583,052 proposes the incorporation of a cationic surfactant in tobacco filler to function as a tar and nicotine absorbent under smoking conditions. One type of surfactant which is disclosed corresponds to the formula:

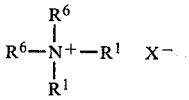

where $R^6$ is an acyclic hydrocarbon radical containing 10–22 carbon atoms, $R^1$ is a lower hydrocarbon such as methyl or ethyl, and X is a halogen or sulfate anion. Also disclosed are pyridinium salts containing the same $R^6$ substituent and X anion as defined above. The $R^6$ substituent according to French Pat. No. 1,583,052 contains at least ten carbon atoms and contributes a fat-solubility property to the surfactants.

As an example of in situ formation of a quaternary ammonium compound in tobacco filler, U.S. Pat. No. 2,985,549 describes a method of forming alkyl nicotinium halide in tobacco by treating the tobacco with an alkyl halide reagent such as methyl chloride. The said treatment of tobacco filler is said to lower the tar and nicotine content of mainstream smoke under smoking conditions.

Bach et al in Fachliche Mitt. Oesterr, Tabakregie, 4, 53(1963), as summarized in C.A., 60, 868(1964), report a method for reducing the nicotine content of tobacco by treating the tobacco with ethylene oxide to convert the nicotine into a N-(β-hydroxyethyl)-3-(N-methyl-2-pyrrolidinyl)pyridinium salt derivative.

Similarly, Obi et al in Tob. Sci., 12 70(1968) report a study of the reaction products of nicotine with ethylene oxide in tobacco leaves. In vitro experiments indicated that a quaternary ammonium compound such as N-hydroxyethylnicotine dihydrochloride under pyrolysis conditions at 600° C. yield products such as nicotine, pyridine, 3-ethylpyridine, 3-cyanopyridine and quinoline.

As indicated by the foregoing description of prior art, there is continuing research effort dedicated to the development of smoking compositions which deliver controlled mainstream smoke compositions, and which provide a sensory satisfying level of pleasant flavor and aroma.

Accordingly, it is a main object of this invention to provide low tar and nicotine delivery smoking compositions which have desirable flavor and aroma characteristics as perceived by experienced smokers.

It is another object of this invention to provide smoking compositions which have incorporated therein a quaternary ammonium additive compound which is characterized by low volatility and low pack aroma.

It is another object of this invention to provide smoking compositions of tobacco and/or tobacco-substitute materials containing a quaternary ammonium compound as a flavorant additive, which additive is adapted to impart improved flavoring to the mainstream smoke and improved aroma to the sidestream smoke under smoking conditions.

It is a further object of this invention to provide smoking compositions containing a quaternary ammonium compound as a humectant flavorant additive, which additive is adapted to function as a moisture control and anti-staling agent during the preparation and storage of the smoking compositions.

Other objects and advantages of the present invention shall become apparent from the accompanying description and examples.

DESCRIPTION OF THE INVENTION

One or more objects of the present invention are accomplished by the provision of a smoking composition which comprises an admixture of (1) combustible filler selected from natural tobacco, reconstituted tobacco and non-tobacco substitutes, and (2) between about 0.001 and 5 weight percent, based on the total weight of filler, of a quaternary ammonium additive compound corresponding to the formula:

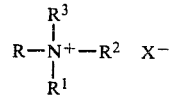

wherein R, $R^1$, $R^2$ and $R^3$ individually are selected from aliphatic, alicyclic and aromatic radicals containing between 1 and about 8 carbon atoms; R and $R^1$ when taken together with connecting elements for a heteroalicyclic structure, and R, $R^1$ and $R^2$ when taken together with connecting elements form a heteroaromatic structure; and X is an organic acid anion.

In a more particular aspect, this invention provides a smoking composition which comprises an admixture of (1) combustible filler selected from natural tobacco, reconstituted tobacco and non-tobacco substitutes, and (2) between about 0.001 and 5 weight percent, based on the total weight of filler, of a humectant flavorant additive compound corresponding to the formula:

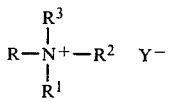

wherein R, $R^1$, $R^2$ and $R^3$ individually are selected from aliphatic, alicyclic and aromatic radicals containing between 1 and about 8 carbon atoms; R and $R^1$ when taken together with connecting elements form a heteroalicyclic structure, and R, $R^1$ and $R^2$ when taken together with connecting elements form a heteroaromatic structure; and Y is a carboxylate anion containing between 2 and about 12 carbon atoms.

Illustrative of R, $R^1$ and $R^2$ and $R^3$ individually are radicals which include methyl, propenyl, butyl, 3-methyl-2-butenyl, pentyl, hexenyl, methoxyethyl, hydroxypropyl, acetyl, cyclopropyl, cyclobutyl, cyclopentyl, cyclohexyl, menthyl, furyl, tetrahydrofuryl, piperidyl, pyrrolidyl, pyrazolyl, phenyl, tolyl, xylyl, benzyl, phenylethyl, methoxyphenyl, pyridyl, pyridazyl, pyrimidyl, pyrazyl, and the like.

The $R^1$ and $R^2$ groups when taken together with the connecting elements form a heteroalicyclic structure such as pyrrolyl, pyrrolidyl, pyridylpyrrolidyl, pyrazolyl, imidazolyl, thiazyl, oxazolyl, indolyl, piperidyl, piperazyl, and the like.

The R, $R^1$ and $R^2$ groups when taken together with connecting elements form a heteroaromatic structure such as pyridyl, pyrrolidylpyridyl, pyridazyl, pyrimidyl, pyrazyl, triazinyl, oxazinyl, quinolyl, and the like.

In the first structural formula disclosed above X is an organic acid anion derived from compounds such as carboxylic acids, sulfonic acids, phosphonic acids, and the like. The organic acids are illustrated by acetic acid, para-toluenesulfonic acid, butylphosphonic acid, and the like.

In the second structural formula disclosed above, Y is a carboxylate anion containing between 2 and about 12 carbon atoms. The carboxylate anion can be derived from either monocarboxylic acids or polycarboxylic acids. Illustrative of carboxylic acids are propionic acid, octanoic acid, decanoic acid, benzoic acid, acrylic acid, galacturonic acid, oxalic acid, succinic acid, maleic acid, itaconic acid, adipic acid, phthalic acid, trimellitic acid, and the like. It is particularly advantageous when Y is a carboxylate anion of carboxylic acids selected from citric acid, malonic acid and tartaric acid. These three carboxylic acids are natural constituents of tobacco leaves.

It is an important feature of the present invention that the quaternary ammonium flavorant additive in the smoking compositions inherently has moisture-retaining properties, i.e., the flavorant additive functions as a humectant and anti-staling agent. Thus, the moisture content of a present invention composition can be maintained in the range of between about 5 and 20 weight percent, based on the total weight of filler, during the preparation and storage of the smoking composition which contains a quaternary ammonium humectant flavorant additive as described above.

The said flavorant additive is a low volatility compound which exhibits low pack aroma. Under normal smoking conditions, or other localized intensive heating conditions, a portion of the flavorant additive volatilizes and evolves as a gas or aerosol component. Concomitantly, an increment of the additive pyrolyzes into products which respectively also exhibit organoleptic properties.

Depending on the structure of the quaternary ammonium flavorant additive, the secondary flavorant compounds are released by one or more reaction mechanisms. The following is an illustration of one of the release mechanisms:

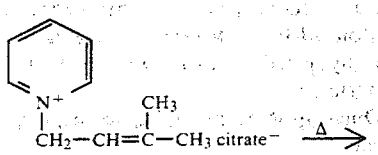

-continued

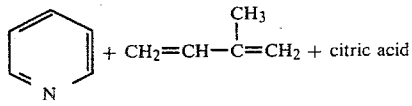

Each of the pyrolysis products illustrated above can impart flavor and aroma to tobacco and non-tobacco smoke under normal smoking conditions.

PREPARATION OF QUATERNARY AMMONIUM COMPOUNDS

A preferred method of preparing quaternary ammonium compounds is by the reaction of amines with alkylating reagents, such as alkyl and aralkyl halides. The amines being alkylated can be primary, secondary or tertiary, and either acylic or heterocyclic, and either monoamine or polyamine.

(1) $R^1R^2R^3N + R{-}Z \longrightarrow R^1R^2R^3N^+R\ \ Z^-$ (2) $R^1R^2NH + 2R{-}Z \longrightarrow R^1R^2N^+RR\ \ Z^-$ (3) $R^1NH_2 + 3R{-}Z \longrightarrow R^1N^+RRR\ \ Z^-$ (4) 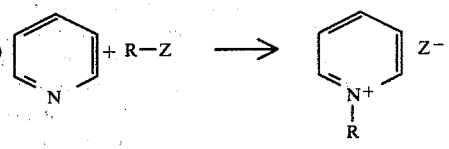

(5) $R^1R^2N{-}R^3{-}NR^1R^2 + 2R{-}Z \longrightarrow R^1R^2RN^+{-}R^3{-}N^+R^1R^2R\ \ 2\,Z^-$ The substituent Z above is usually selected from chlorine, bromine and iodine, and R,$R^1$,$R^2$ and $R^3$ are suitable organic substituents. For purposes of the present invention, a quaternary ammonium halide compound as illustrated above is converted to a quaternary ammonium hydroxide by reaction with a basic reagent such as silver oxide or basic anion exchange resin (e.g., Rexyn 201, Fisher Scientific Co.).

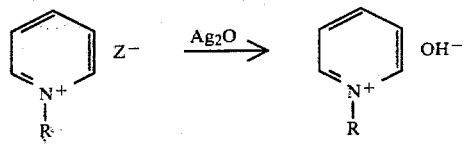

A flavorant additive compound of the present invention can be prepared by interacting an appropriately substituted quaternary ammonium hydroxide compound with an organic acid. The hydroxide anion is exchanged by an organic acid anion.

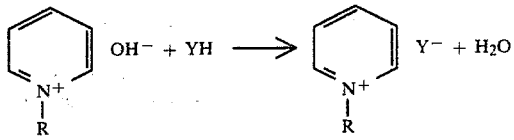

Y above is a carboxylate anion containing between 2 and about 12 carbon atoms, e.g., a preferred species such as citrate, malonate or tartrate. The quaternary ammonium hydroxide compounds tend to be moderately unstable both in solution and in the solid state. The quaternary ammonium halide compounds are stable, but are undesirable as flavorant additive compounds in smoking compositions because they have the potential to release hydrogen halide as a toxic component of smoke under normal smoking conditions.

PREPARATION OF TOBACCO COMPOSITIONS

The present invention smoking compositions can be prepared by admixing natural tobacco and/or reconstituted tobacco and/or a non-tobacco substitute with between about 0.001 and 5 weight percent based on the weight of the smoking composition, of a flavorant additive which corresponds to one of the structural formulae set forth hereinabove in definition of the quaternary ammonium compounds.

The invention quaternary ammonium flavorant additive can be incorporated into the tobacco in accordance with methods known and used in the art. Preferably the flavorant additive is dissolved in a solvent such as water, alcohol, or mixtures thereof, and then sprayed or injected into the tobacco or non-tobacco substitute matrix. Such method ensures an even distribution of the flavorant additive throughout the tobacco, and thereby facilitates the production of a more uniform smoking composition. Alternatively, the flavorant may be incorporated as part of a concentrated tobacco extract which is applied to a fibrous tobacco web as in the manufacture of reconstituted tobacco. Another suitable procedure is to incorporate the flavorant in tobacco or non-tobacco substitute filler in a concentration between about 1–10 weight percent, based on the weight of filler, and then subsequently to blend the treated filler with filler which does not contain flavorant additive.

The term "non-tobacco substitute" is meant to include smoking filler materials such as are disclosed in U.S. Pat. Nos. 3,529,602; 3,703,177; 3,796,222; 4,019,521; 4,079,742; and references cited therein; incorporated herein by reference.

Illustratively, U.S. Pat. No. 3,529,602 describes a burnable sheet which may be used as a tobacco substitute, which sheet contains ingredients which include (1) a film-forming ingredient comprising a pectinaceous material derived from tobacco plant parts and having an acid value in excess of 30 milligrams of potassium hydroxide per gram, and (2) a mineral ingredient comprising an alkali metal salt, an alkaline earth metal salt or a clay.

U.S. Pat. No. 3,703,177 describes a process for preparing a non-tobacco smoking product from sugar beet pulp, which process involves the acid hydrolysis of the beet pulp to release beet pectins, and at least an alkaline earth treatment thereafter to cause crosslinking of the pectins and the formations of a binding agent for the exhausted beet matrix.

U.S. Pat. No. 3,796,222 describes a smoking product derived from coffee bean hulls. The hulls are treated with reagents that attack the alkaline earth metal crosslinks causing the release of the coffee pectins. The pectins act as a binding agent and together with the treated hulls may be handled and used similarly to a tobacco product.

U.S. Pat. No. 4,019,521 discloses a process for forming a smoking material which involves heating a cellulosic or carbohydrate material at a temperature of 150°–750° C. in an inert atmosphere for a period of time sufficient to effect a weight loss of at least 60 percent but not more than 90 percent.

U.S. Pat. No. 4,079,742 discloses a process for the manufacture of a synthetic smoking product from a cellulosic material, which process involves a pyrolysis step and a basic extraction step to yield a resultant matrix which has a tobacco-like brown color and has improved smoking characteristics.

The following examples are further illustrative of the present invention. The reactants and other specific ingredients are presented as being typical, and various modifications can be derived in view of the foregoing disclosure within the scope of the invention.

EXAMPLE I

This Example illustrates the preparation of N-methylpyridinium citrate.

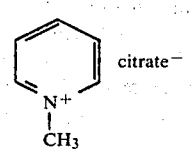

A solution of 0.440 gram (0.002 mol) of N-methylpyridinium iodide in 5 ml of water is placed onto a prewashed Rexyn 201 column (about 20 grams) and is washed with water. After a short forerun of about one column volume, the eluant begins to turn slightly yellow. The pH of the eluant is initially neutral but turns highly basic at the first sign of the yellow color. The column is washed with additional water until the eluant is neutral. The combined washes are kept under an atmosphere of nitrogen to prevent oxidation. Citric acid (0.190 gram) is added to the combined washes and the resultant solution is lypholized until only about 5 milliliters of solution remain. This solution of N-methylpyridinium citrate is stable as determined by an unchanged nmr spectrum profile over a period of time.

EXAMPLE II

This Example illustrates the preparation of a variety of quaternary ammonium flavorant compounds employing the procedure of Example I.

A. N-Ethylpyridinium citrate

Pyridine is reacted with ethyl iodide; the halide intermediate is converted to the hydroxide with Rexyn 201 (Fisher Scientific Co.), and then reacted with citric acid.

B. N-Allylpyridinium citrate

Pyridine is reacted with allyl bromide; the halide intermediate is converted to the hydroxide with Rexyn 201, and then reacted with citric acid.

C. N-methyl-2,3-dimethylpyridinium citrate 2-3-Lutidine is reacted with methyl iodide; the halide intermediate is converted to the hydroxide with Rexyn 201, and then reacted with citric acid.

D. N-(3-Methyl-2-butenyl)-4-methylpyridinium citrate

4-Picoline is reacted with 3-methyl-2-butenyl bromide in acetonitrile; the halide intermediate is converted to the hydroxide with Rexyn 201, and then reacted with citric acid.

E. N,N-Dimethyl-N-(3-methyl-2-butenyl)phenylammonium citrate

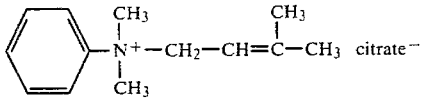

N,N-dimethylaniline is reacted with 3-methyl-2-butenyl bromide in benzene; the halide intermediate is converted to the hydroxide with Rexyn 201, and then reacted with citric acid.

F. N-Ethylquinolinium malonate

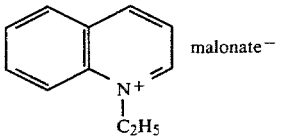

Quinoline is reacted with ethyl iodide in acetonitrile; the halide intermediate is converted to the hydroxide with Rexyn 201, and then reacted with malonic acid.

G. N-Ethylisoquinolinium tartrate

Isoquinoline is reacted with ethyl iodide in acetonitrile; the halide intermediate is converted to the hydroxide with Rexyn 201, and then reacted with tartaric acid.

H. N-(3-Methyl-2-butenyl)-3-methylpyridinium citrate

3-Picoline is reacted with 1-bromo-3-methyl-2-butene in acetonitrile; and the halide intermediate is converted to the hydroxide with Rexyn 201 and then reacted with citric acid to form the citrate.

I. N-(3-Methyl-2-butenyl)-3-acetylpyridinium citrate

3-Acetylpyridine is reacted with 1-bromo-3-methyl-2-butene in acetonitrile; the halide intermediate is converted to the hydroxide in methanolic sodium hydroxide, and then reacted with citric acid.

J. N-Methylnicotinium citrate

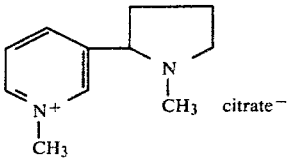

Nicotine is reacted with methyl iodide in acetic acid; the halide intermediate is converted to the hydroxide with Rexyn 201, and then reacted with citric acid.

K. N'-methylnicotinium citrate

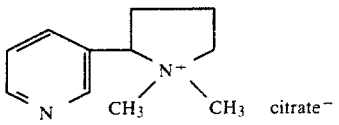

Nicotine is reacted with methyl iodide in acetonitrile, and the halide intermediate is recovered by extraction with solvent. The halide intermediate is converted to the hydroxide with Rexyn 201, and then reacted with citric acid.

N'-Hydrido-N-ethylnicotinium citrate

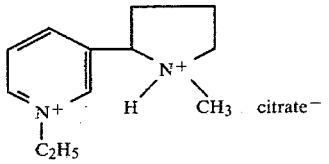

Nicotine.dihydrogen iodide is reacted with nicotine to form nicotine.hydrogen iodide. The nicotine.hydrogen iodide is reacted with ethyl iodide; the resultant halide intermediate is converted to the hydroxide with Rexyn 201, and then reacted with citric acid.

M. N-(3-Methyl-2-butenyl)-3-cyanopyridinium citrate

3-Cyanopyridine is reacted with 1-bromo-3-methyl-2-butene in acetonitrile; and the halide intermediate is reacted with sodium citrate.

Following the general procedures illustrated above, as additional flavorant additive compounds there are prepared N-(3-methyl-2-butenyl)pyridinium citrate; N-(3-methyl-2-butenyl)pyridinium galacturonate; and a mixture of N-(3-methyl-2-butenyl)nicotinium citrate and N'-(3-methyl-2-butenyl)nicotinium citrate.

Also prepared are tetrabutylammonium succinate; phenyltrimethylammonium borate; N,N-di(1-hexyl)-piperidinium maleate; N-methylthiazolium citrate; N-ethyloxazolium tartrate; N-methyl-N-(4-pyridyl)pyrrolidinium malonate; amyl-diethyl-2,3-dihydroxypropylammonium phthalate; and the like.

EXAMPLE III

This Example illustrates the preparation of smoking compositions in accordance with the present invention.

Cigarettes are fabricated using tobacco treated with 0.2% of N-methylpyridinium citrate, N-(3-methyl-2-butenyl)-3-acetylpyridinium citrate, N-ethylquinolinium malonate, N-ethylisoquinolinium tartrate, N-(3-methyl-2-butenyl)-nicotinium citrate or 1,6-di(triethylammonium)hexane ditartrate. The cigarettes were targeted to deliver 5–6 mg tar per cigarette.

Untreated controls are prepared, and the treated cigarettes are found to have a mellow fruity note, more body and more response as compared to the controls.

EXAMPLE IV

This Example illustrates the production of secondary organoleptic compounds which result from the decomposition of quaternary ammonium additive compounds of the present invention.

A variety of different quaternary ammonium additive compounds were incorporated into low delivery cigarettes, and the cigarettes were machine smoked under laboratory test conditions in comparison to control cigarettes. The data for each type of additive compound and the resultant mainstream smoke analyses are summarized in the Table.

A conventional cellulose acetate filter (21 mm length) was employed in the cigarettes (85 mm) each of which contained 0.85 gram of tobacco.

TABLE

| Quaternary Ammonium Flavorant Additive | Mg. Of Flavorant Per Cgt.[k] | Wt. % Of Flavorant Per Cgt.[c] | Mainstream Smoke Analysis[a,b] |
|---|---|---|---|
| N-Methylpyridinium citrate | 3.40 | 0.60 | pyridine (34 μg, 1%)[b,e]<br>$CH_3OH$ (3.11/2.41)[d] |
| N-Ethylpyridinium citrate | 5.38 | 0.75 | pyridine (121.5 μg, 2.3%)[b,e]<br>ethylene (.141/.131)[d]<br>$CH_3OH$ (3.15/2.41)[d] |
| N-Allylpyridinium citrate | 7.17 | 1.0 | pyridine (46 μg 0.64%)[b,e] |
| N-Methyl-2,3-dimethyl-pyridinium citrate | 7.12 | 1.0 | 2,3 lutidine (44 μg, 0.6%)[b,e]<br>$CH_3OH$ (3.16/2.41)[d] |
| N-(3-Methyl-2-butenyl)-4-methyl-pyridinium citrate | 7.11 | 1.0 | 4-picoline (26.5 μg, 0.37%)[b,e]<br>isoprene (.201/.116)[d] |
| Dimethyl-(3-methyl-2-butenyl)-phenylammonium citrate | 7.26 | 1.0 | N,N,dimethylaniline (204.5 μg, 2.8%)[b,e]<br>isoprene (.201/.116)[d] |
| N-Ethylquinolinium malonate | 7.20 | 1.0 | quinoline (12 μg, 0.17%)[b,e]<br>ethylene (.142/.131)[d] |
| N-Ethylisoquinolinium tartrate | 7.20 | 1.0 | isoquinoline (44 μg, 0.61%)[b,e]<br>ethylene (.132/.131)[d] |
| N-(3-Methyl-2-butenyl)-3-methyl-pyridinium citrate | 7.16 | 1.0 | 3-picoline (30 μg, 0.42%)[b,e]<br>isoprene (.188/116)[d] |
| N-(3-Methyl-2-butenyl)-3-acetyl-pyridinium citrate | 4.4 | 0.61 | 3 acetyl pyridine (55 μg, 1.3%)[b,e]<br>isoprene (.191/.116)[d] |
| N'-Methylnicotinium citrate | 7.16 | 1.0 | nicotine (96 μg/1.3%)[b,e,g]<br>$CH_3OH$ (1.96/2.41)[d] |
| N-Methylnicotinium citrate | 7.14 | 1.0 | nicotine (99 μg/1.4%)[b,e,g]<br>$CH_3OH$ (1.85/2.41)[d] |
| N-Hydrido-N'-ethylnicotinium citrate | 14.32 | 2.0 | nicotine (227 μg/1.6%)[b,e,g]<br>ethylene (.1601/.131) |
| N-(3-Methyl-2-butenyl)-3-cyano-pyridinium citrate[f] | 7.28 | 1.0 | 3-cyanopyridine (35 μg, 0.48%)[b,e]<br>isoprene (.224/.116)[d] |
| N-(3-Methyl-2-butenyl)pyridinium citrate | 9.0[h] | 0.90 | isoprene (269 μg, 9.0%)[b,e]<br>ethylene (24 μg, 0.5%)[d] |
| N-(3-Methyl-2-butenyl)pyridinium galacturonate | 15.8[i] | 1.58 | isoprene (646 μg, 4.8%)[b,e]<br>ethylene (none observed) |
| N-(3-Methyl-2-butenyl)nicotinium citrate and N'-(3-methyl-2-butenyl)nicotinium citrate | 2.86[h,j] | 0.29 | nicotine (0.42 mg, 10%)[b,e]<br>isoprene (0.30 mg, 22%)[b,e]<br>isoprene sidestream (none observed) |

[a]Amines and heteroaromatic compounds analyzed by gas chromotography using a Perkin-Elmer Model 3920 Gas Chromatography Instrument. For amines and heteroaromatic compounds, four cigarettes were smoked under usual conditions using the same TPM pad. The pad was extracted with acetone and the acetone extract was analyzed. Appropriate calibration curves using purified amines and heteroaromatic compounds were obtained in each case. Gas phase analyses were performed by standard infrared analysis procedures on mainstream smoke. Methanol and ethanol are reported as determined for "total alcohol."

[b]Corrected for control cigarette which was prepared in an identical manner as the experimental cigarette with the exception that no quaternary salt was added in either methanol, ethanol or water.

[c]Based on 720 mg filler per cigarette.

[d]The first figure represents the value determined in the experimental cigarette; the second figure represents the value determined in the control cigarette. See footnote b above.

[e]The first figure represents the net (experimental cigarette value minus control cigarette value) component delivery in micrograms. The second figure represents the net chemical yield to mainstream TPM.

[f]Prepared by adding one equivalent sodium citrate to a solution of 1-(3-methyl-2-butenyl)-3-cyanopyridinium bromide in water. The corresponding hydroxide was not readily preparable using ion exchange procedures and consequently was not used in preparation of the citrate, tartrate or malonate.

[g]Corrected for 580 μg/cgt in the control.

[h]Low alkaloid burley-bright (1:1) filler, 1 g capacity, excel paper, 67 mm long, 36 sec porosity, nonfilter handmade cigarette. Substrate sprayed onto filler and equilibrated for 24 hours.

[i]100 mmol quaternary salt in 250 ml water incorporated onto 454 g LTF.

[j]0.0177 mmol/g nicotine quaternary salt added to low alkaloid burley-bright (1:1) filler.

[k]Unless otherwise indicated, the quaternary salt was added in aqueous solution via the syringe technique.

EXAMPLE V

This Example illustrates that the presence of a present invention quaternary ammonium additive compound in a tobacco composition does not affect substantially the quantities of tar and nicotine components delivered in the mainstream smoke of cigarettes, which components are derived from the tobacco filler under smoking conditions.

| N-Isopentenylpyridinium Citrate Additive[a] | | |
|---|---|---|
| | Control | Sample |
| Pyridine[b] | 6 | 240 |
| Isoprene[b] | 402 | 1507 |
| TPM | 22.9 | 22.8 |
| Nicotine[c] | 1.0 | 1.1 |
| Water[c] | 2.2 | 2.0 |

-continued

| N-Isopentenylpyridinium Citrate Additive[a] | | |
|---|---|---|
| | Control | Sample |
| Ethylene[b] | 158 | 134 |

[a]0.185 mmole of additive added per cigarette.
[b]μg/cgt mainstream.
[c]mg/cgt mainstream.

What is claimed is:

1. A smoking composition comprising an admixture of (1) combustible filler selected from natural tobacco, reconstituted tobacco and non-tobacco substitutes, and (2) between about 0.001 and 5 weight percent, based on the total weight of filler, of a quaternary ammonium additive compound corresponding to the formula:

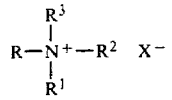

wherein R, $R^1$, $R^2$ and $R^3$ individually are selected from aliphatic, alicyclic and aromatic radicals containing between 1 and about 8 carbon atoms; R and $R^1$ when taken together with connecting elements form a heteroalicyclic structure, and R, $R^1$ and $R^2$ when taken together with connecting elements form a heteroaromatic structure; and X is an organic acid anion.

2. A smoking composition comprising an admixture of (1) combustible filler selected from natural tobacco, reconstituted tobacco and non-tobacco substitutes, and (2) between about 0.001 and 5 weight percent, based on the total weight of filler, of a humectant flavorant additive compound corresponding to the formula:

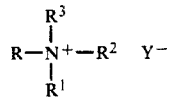

wherein, R, $R^1$, $R^2$ and $R^3$ individually are selected from aliphatic, alicyclic and aromatic radicals containing between 1 and about 8 carbon atoms; R and $R^1$ when taken together with connecting elements form a heteroalicyclic structure, and R, $R^1$ and $R^2$ when taken together with connecting elements form a heteroaromatic structure; and Y is a carboxylate anion containing between 2 and about 12 carbon atoms.

3. A smoking composition in accordance with claim 2 wherein the composition contains between about 5 and 20 weight percent moisture, based on the total weight of filler.

4. A smoking composition in accordance with claim 2 wherein R and $R^1$ when taken together with connecting elements form a pyrrolidine or piperidine structure.

5. A smoking composition in accordance with claim 2 wherein R, $R^1$ and $R^2$ when taken together with connecting elements form a pyridine structure.

6. A smoking composition in accordance with claim 2 wherein the carboxylate anion is derived from citric acid.

7. A smoking composition in accordance with claim 2 wherein the carboxylate anion is derived from malonic acid.

8. A smoking composition in accordance with claim 2 wherein the carboxylate anion is derived from tartaric acid.

9. A smoking composition in accordance with claim 2 wherein the carboxylate anion is derived from galacturonic acid.

10. A smoking composition comprising an admixture of (1) combustible filler selected from natural tobacco, reconstituted tobacco and non-tobacco substitutes, and (2) between about 0.001 and 5 weight percent, based on the total weight of filler, of a humectant flavorant additive compound corresponding to the formula:

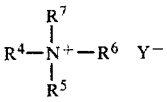

wherein $R^4$, $R^5$, $R^6$ and $R^7$ individually are selected from aliphatic, alicyclic and aromatic radicals containing between 1 and about 8 carbon atoms; $R^4$ and $R^5$ when taken together with connecting elements form a pyrrolidine structure, and $R^4$, $R^5$ and $R^6$ when taken together with connecting elements form a pyridine structure; and Y is a carboxylate anion containing between 2 and about 12 carbon atoms.

11. A smoking composition in accordance with claim 10 wherein the composition contains between about 5 and 20 weight percent moisture, based on the total weight of filler.

12. A smoking composition in accordance with claim 10 wherein the carboxylate anion is derived from carboxylic acids selected from citric acid, malonic acid and tartaric acid.

13. A smoking composition in accordance with claim 10 wherein the flavorant additive is N-methylpyridinium citrate.

14. A smoking composition in accordance with claim 10 wherein the flavorant additive is N-ethylpyridinium citrate.

15. A smoking composition in accordance with claim 10 wherein the flavorant additive is N-allylpyridinium citrate.

16. A smoking composition in accordance with claim 10 wherein the flavorant additive is N-methyl-2,3-dimethylpyridinium citrate.

17. A smoking composition in accordance with claim 10 wherein the flavorant additive is N-(3-methyl-2-butenyl)-4-methylpyridinium citrate.

18. A smoking composition in accordance with claim 10 wherein the flavorant additive is N,N-dimethyl-N-(3-methyl-2-butenyl)phenylammonium citrate.

19. A smoking composition in accordance with claim 10 wherein the flavorant additive is N-ethylquinolinium malonate.

20. A smoking composition in accordance with claim 10 wherein the flavorant additive is N-ethylisoquinolinium tartrate.

21. A smoking composition in accordance with claim 10 wherein the flavorant additive is N-(3-methyl-2-butenyl)-3-methylpyridinium citrate.

22. A smoking composition in accordance with claim 10 wherein the flavorant additive is N-(3-methyl-2-butenyl)-3-acetylpyridinium citrate.

23. A smoking composition in accordance with claim 10 wherein the flavorant additive is N′-methylnicotinium citrate.

24. A smoking composition in accordance with claim 10 wherein the flavorant additive is N-methylnicotinium citrate.

25. A smoking composition in accordance with claim 10 wherein the flavorant additive is N'-hydrido-N-ethylnicotinium citrate.

26. A smoking composition in accordance with claim 10 wherein the flavorant additive is N-(3-methyl-2-butenyl)-3-cyanopyridinium citrate.

27. A smoking composition in accordance with claim 10 wherein the flavorant additive is N-(3-methyl-2-butenyl)-pyridinium citrate.

28. A smoking composition in accordance with claim 10 wherein the flavorant additive is N-(3-methyl-2-butenyl)-pyridinium galacturonate.

29. A smoking composition in accordance with claim 10 wherein the flavorant additive is N-(3-methyl-2-butenyl)-nicotinium citrate.

30. A smoking composition in accordance with claim 10 wherein the flavorant additive is N'-(3-methyl-2-butenyl)-nicotinium citrate.

* * * * *